United States Patent [19]

Roeder

[11] 4,248,299

[45] Feb. 3, 1981

[54] PACKER NOSE ASSEMBLY

[76] Inventor: George K. Roeder, P.O. Box 4335, Odessa, Tex. 79760

[21] Appl. No.: 947,695

[22] Filed: Oct. 2, 1978

[51] Int. Cl.[2] ..... E21B 33/12

[52] U.S. Cl. ..... 166/153; 92/252; 92/253; 166/202

[58] Field of Search ..... 92/252-254; 166/202, 153, 106

[56] References Cited

U.S. PATENT DOCUMENTS

| | | | |
|---|---|---|---|
| 2,893,493 | 7/1959 | Copas | 166/202 |
| 3,179,022 | 4/1965 | Bloudoff | 92/252 |
| 3,343,461 | 9/1967 | Tinsley | 92/253 |
| 3,796,260 | 3/1974 | Bradley | 166/202 |

*Primary Examiner*—William F. Pate, III
*Attorney, Agent, or Firm*—Marcus L. Bates

[57] ABSTRACT

A packer nose assembly for pumping downhole equipment of the free type into and out of boreholes. The assembly includes a mandrel having a lower end portion attachable to the downhole equipment and an upper end portion terminating in the form of a fishing neck. One or more packers are slidably received in a telescoping manner upon the mandrel and anchored into position by spaced sleeves which are likewise slidably received upon the mandrel. The packer is cylindrical in form and includes a plurality of spaced fins formed about the exterior thereof with each fin being circumferentially disposed about and radiating from the body portion. The fins taper in thickness in an outward direction from the body portion.

2 Claims, 6 Drawing Figures

PACKER NOSE ASSEMBLY

BACKGROUND OF THE INVENTION

It is often desirable to place various downhole equipment into a borehole and later on retrieve the equipment from the borehole. For example in a cased borehole having a production tubing extending downhole into proximity of a fluid producing formation, it is often desirable to place a package of instruments or other downhole equipment in the production tubing by circulating fluid in a downward direction through the production tubing until the package arrives at its destination. Later, when it is desired to retrieve the package of instruments, reverse circulation can be employed to circulate the package back uphole to the top of the production tubing.

Accordingly, is is desirable to have made available a packer nose assembly for pumping downhole equipment of the free type into and out of boreholes. It is further desirable that the packer nose assembly be of a design which produces high friction flow across a packer element thereof so that very little slippage of fluid occurs as the assembly is being circulated into or out of a borehole.

SUMMARY OF THE INVENTION

A packer nose assembly for pumping downhole equipment of the free type into and out of boreholes. The assembly comprises a mandrel having a lower end portion which can be removably affixed to the downhole equipment, a fishing neck on the opposed upper end portion thereof, and further includes packer means located intermediate the oppposed ends of the mandrel.

The packer is cylindrical in form and has an axial passageway formed through a central body portion thereof with the outermost diameter of the packer being in the form of axially aligned spaced adjacent fins, with each fin being circumferentially disposed about and radiating from the body portion. The packer nose assembly is especially adapted for forming the upper terminal end of a free type downhole hydraulically actuated pump assembly.

A primary object of this invention is to provide improvements in packer nose assemblies for downhole equipment of the free type.

Another object of the invention is to provide a packer nose assembly for a free type downhole hydraulically actuated pump assembly.

A further object of this invention is to disclose and provide a packer for pumping downhole equipment into and out of a borehole.

A still further object of this invention is to provide a resilient packer member which is efficient in operation, rugged in design, and low in cost.

Still another object of this invention is the provision of a packer nose assembly which can free fall through a liquid column at a slow rate of speed.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
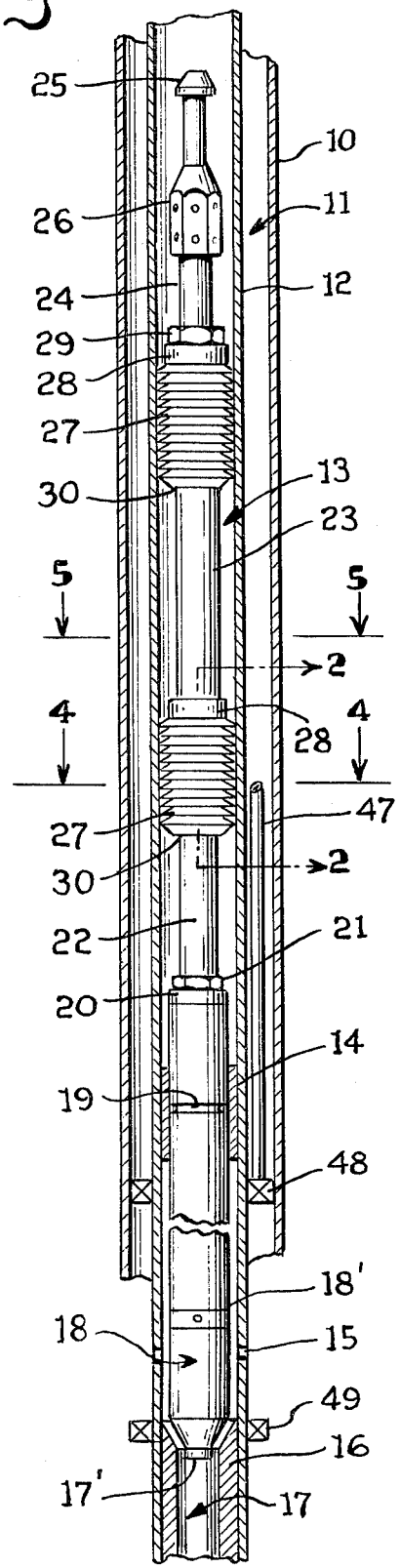
FIG. 1 is a vertical, part cross-sectional view of a borehole having disposed therein apparatus made in accordance with the present invention.

In the drawings, there is disclosed in FIG. 1 a casing 10 representative of a portion of a cased borehole which extends into the ground. A casing annulus 11 is formed between the casing and production tubing 12, while a tubing annulus 13 is formed between the illustrated downhole equipment and the tubing string. An o-ring collar 14 of the usual design forms part of the tubing string.

Production ports 15 provide for fluid flow therethrough. A shoe 16 forms a seat and sometimes includes a check valve located at 17. Fluid is free to flow from a production formation (not shown) into an inlet 17' of a downhole hydraulically actuated pump assembly 18. Within an o-ring groove 19, there can be placed an o-ring which sealingly engages the o-ring collar. An upper extremity 20 of the pump assembly is removably attached to a packer nose assembly by attaching means 21, sometimes called a sub. The packer nose assembly is the subject of this invention.

Sleeves 22 and 23 are spaced from one another and slidably received about a mandrel 24. The sleeves underlie a fishing neck 25, with the fishing neck preferably enlarging at 26 so as to provide structure within which an inlet port can be formed for flow of power fluid into the pump engine in the usual manner.

Interposed between the spaced sleeves are spaced resilient packers 27 having the illustrated conical spacers 28 interposed between an uppermost sleeve and the packer. Fastener means 29 maintains the packers and the sleeves anchored in properly positioned relationship upon a mandrel 24'.

Figure 2:
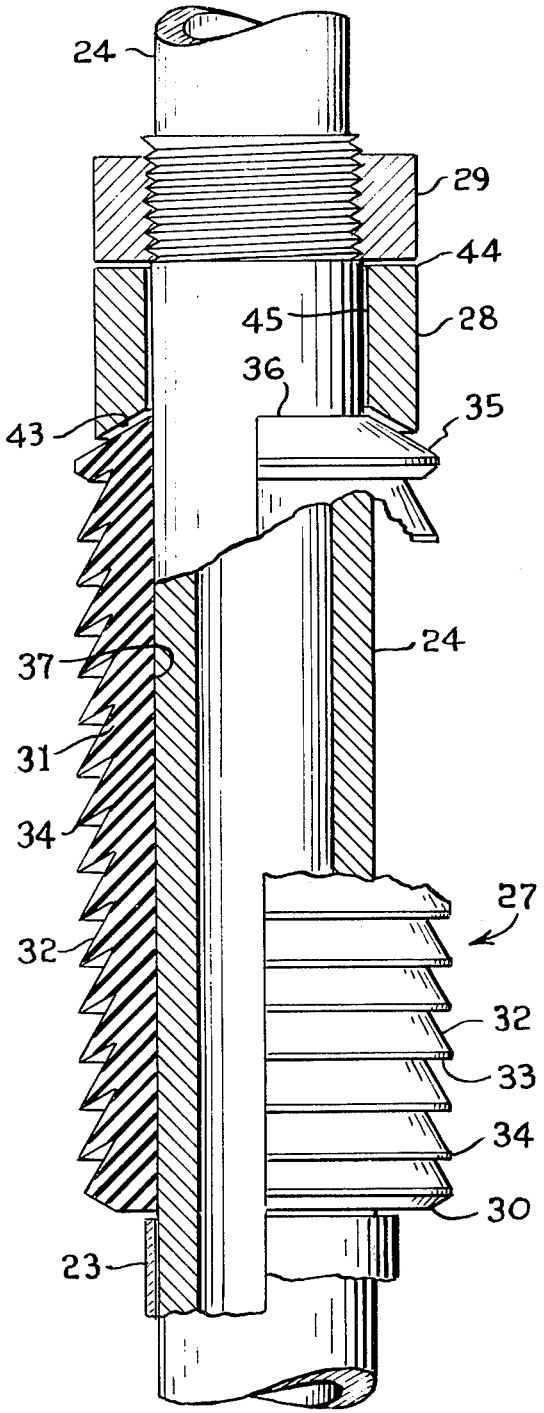
FIG. 2 is an enlarged, part cross-sectional fragmentary view taken along lines 2—2 of FIG. 1.
Figure 5:
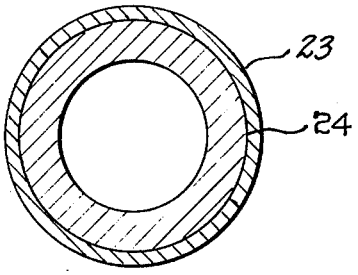
FIGS. 4 and 5, respectively, are enlarged, cross-sectional views taken along lines 404 and 5—5, respectively, of FIG. 1; and, FIG. 6 is a reduced side elevational view of a modification of the apparatus disclosed in FIG. 1.
Figure 4:
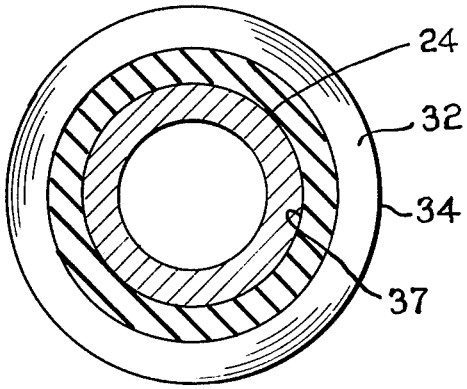

Each packer is provided with a lower boss 30 which abuttingly engages one of the before mentioned sleeves. As best seen in FIG. 2, in conjunction with the remaining figures, each packer has a body portion 31 from which there radiates a plurality of concentrically arranged spaced fins with each of the fins having a circumferentially extending downwardly directed sloped wall portion 32 which terminates at edge portion 33, thereby leaving a vertical edge portion 34 therebetween. The uppermost radial fin 35 includes the illustrated tapered wall portion which terminates in an innermost edge portion 36.

The body portion of the packer has a longitudinally extending axial bore 37 of a constant diameter which enables it to be slidably received in a telescoping manner in close tolerance relationship upon the outer peripheral wall surface of the mandrel.

Figure 3:
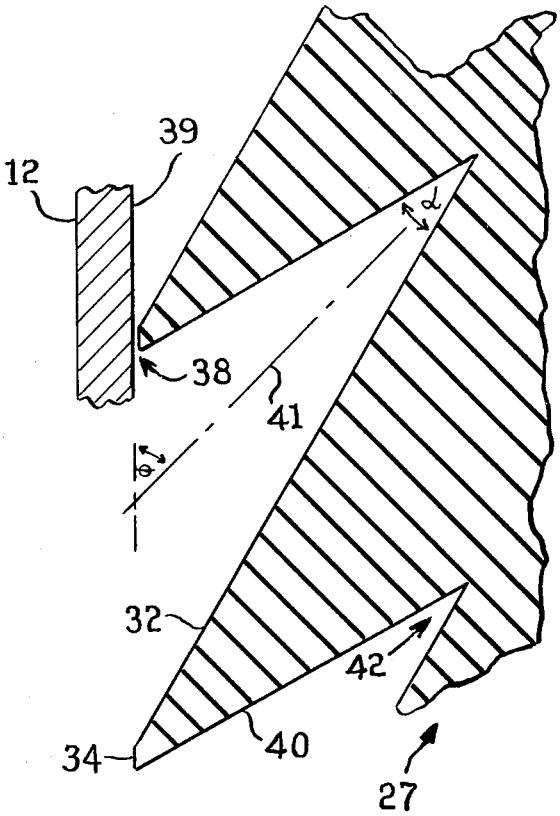
FIG. 3 is an enlarged, fragmentary cross-sectional representation of part of the apparatus seen in FIG. 2.

As seen in FIG. 3, the outermost edge portion of each fin is spaced approximately 0.015 inches from the inside peripheral wall 39 of the tubing. The fins include spaced walls 32, 40 which terminate in spaced relationship to form the before mentioned vertical edge portion 34, with the fins preferably being formed by utilizing a cutting tool with opposed faces thereof arranged to form 25°-35° so as to provide the upwardly and inwardly disposed cutout $\alpha$. The cutting tool preferably is set along line 41 relative to the central axis of the packer and at an angle —$\theta$— 35°-55°. By turning the circumferentially extending, radially disposed, downwardly directed fins in an engine lathe in this matter, the resultant packer element can be efficiently and economically produced. By maintaining the downward angle of the fins within the recited limits, several unexpected advantages are realized, as will be explained in greater detail later on.

The before mentioned conical spacer is provided with a sloped wall 43 complementary relative to wall 35. Face 44 of the spacer abuts nut 29 which in turn threadedly engages the upper reduced diameter portion 24' of the mandrel. The inside diameter 45 of the spacer is slidably received over the illustrated threads, while the before mentioned fishing neck 26 threadedly engages the upper terminal end of the mandrel to enable disassembly of the packer nose assembly.

The apparatus is assembled by threadedly engaging the lower terminal end of the mandrel with the upper terminal end 20 of the downhole equipment. Sleeve 22, packer 27, spacer 28, sleeve 23, packer 27, and spacer 28 are pressed or slidably positioned upon the mandrel and the nut 29 tightly made up. The fishing neck is then threadedly affixed to the upper marginal depending end of the mandrel and the assembly is ready to be placed within the production tubing of the borehole.

Where the packer nose assembly is used in conjunction with a hydraulically actuated downhole pump, it is necessary that a hollow mandrel be employed, with the mandrel being in fluid communication with the valve section of the engine of the downhole pump as well as with the illustrated apertures seen at 26 in FIG. 1.

Figure 6:
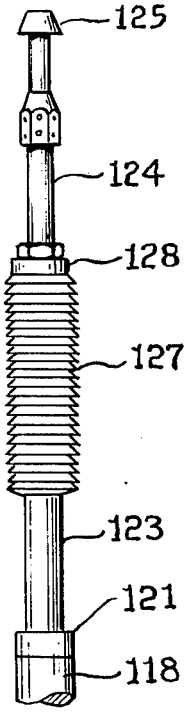

In the embodiment of FIG. 6, like or similar numerals correspond to like or similar elements found in FIGS. 1 through 5. Specifically, the downhole pump assembly 118 is removably attached to the packer nose assembly by attachment means 121. Sleeves 123 and 124 underlie a fishing neck 125. An elongated resilient packer 127 abuts a conical spacer 128 in the same illustrated manner of FIG. 2.

OPERATION

The apparatus is placed into the upper open end of the production tubing and gently released into the fluid column contained therewithin whereupon the apparatus will freely fall at a gentle rate of descent until the entire assembly arrives downhole in a manner such as illustrated in FIG. 1.

When it is desired to retrive the downhole equipment from the bottom of the borehole, reverse circulation is employed so as to provide an upward force against the packers, thereby pumping the apparatus upwardly through the tubing to the surface.

The configuration of the fins enable the packers to ride through thousands of feet of tubing in making the trip to and from the surface of the ground without appreciable wear each round trip. Where the inside diameter of the tubing has been properly broached, the packer nose assembly can make a plurality of round trips before replacement is required of the packer elements.

In free falling to the bottom of the hole, outermost edge 34 of the individual fins cause fluid to flow thereacross at a relative high velocity as compared to the velocity of fluid flowing through the chamber formed by the spaced fins and the inner peripheral side wall of the tubing. The fluid, in flowing across the small annulus at 38, tends to bias the fin in an upward direction so that the rate of descent is controlled in proportion to the pressure drop across the edge portion at 38. The individual packer elements may be made of a plastic material such as Delrin (Commercial Plastics and Supply Corp., Dallas, Tex.), when the downhole temperature and pressure will permit. Teflon ®, polyester, and polyethylene are more suitable materials, with polyester generally being the best material for use in oil wells because of its compatability with bottom hole conditions.

I claim:

1. A downhole hydraulically actuated pump assembly of the free type having a packer nose assembly affixed to one end thereof for enabling the apparatus to be pumped into and out of boreholes, said packer nose assembly comprising:

a mandrel having a lower end portion and an upper end portion; means forming a fishing neck on said upper end portion; a lower fastener means formed on said lower end portion of said mandrel by which said packer nose assembly can be removably affixed to one end of the pump assembly;

an upper and lower cylindrical packer, each having opposed terminal ends, a boss at one terminal end and a sloped face at the other terminal end; and a body portion of a longitudinal length defined by the distance measured between said boss and the sloped face; means forming a longitudinal axial passageway through said body portion of each said packer, said axial passageway having an inside diameter which enables each said packer to be slidably received in a telescoping manner about a marginal longitudinally extending portion of the exterior of said mandrel;

a marginal exterior portion of each said packer being formed into a plurality of concentrically arranged, spaced fins; each said fin being an intergral part of said body and circumferentially disposed about and radiating from said body portion; each said fin being formed by adjacent spaced walls, each said spaced wall being outwardly and downwardly extended and converging towards one another at an acute angle relative to one another, thereby forming the fin which is outwardly reduced in cross-section and which downwardly an outwardly extends from said body;

a lowermost and uppermost sleeve telescopingly received on the exterior of said mandrel, said lowermost sleeve being received between the lower boss of said lower packer and said fastener means on said lower end portion of said mandrel for maintaining said packer properly positioned in fixed relationship relative to said mandrel, said uppermost sleeve being received between the boss of the remaining said packer and the sloped face of the lowermost packer; an upper fastener means formed between said fishing neck and said sloped face of said upper packer; said sleeves and said packers being placed in compression on said mandrel by said upper and lower fastener means for maintaining the packers anchored relative to said mandrel.

2. The packer nose assembly of claim 1 wherein said spaced walls are arranged at an angle of 25°-35° relative to one another, and disposed at an angle of 35°-55° relative to the longitudinal axis of the packer.

* * * * *

UNITED STATES PATENT AND TRADEMARK OFFICE

CERTIFICATE OF CORRECTION

PATENT NO. : 4,248,299

DATED : FEBRUARY 3, 1981

INVENTOR(S) : GEORGE K. ROEDER

It is certified that error appears in the above—identified patent and that said Letters Patent is hereby corrected as shown below:

Column 2, line 11, substitute --4-4-- for "404"; Column 2, line 67, substitute --.015-- for "0.015";

Column 3, line 6, substitute --$\alpha$-- for "a"; Column 3, line 32, substitute --a-- second occurrence for "the";

Claim 1, line 40, correct the spelling of "integral".

Signed and Sealed this

*Fourteenth* Day of *July 1981*

[SEAL]

*Attest:*

GERALD J. MOSSINGHOFF

*Attesting Officer*

*Commissioner of Patents and Trademarks*